US008616901B2

(12) United States Patent
Shindo

(10) Patent No.: US 8,616,901 B2
(45) Date of Patent: Dec. 31, 2013

(54) CIRCUIT BOARD ASSEMBLY, BOARD DEVICE, AND METHOD FOR ASSEMBLING CIRCUIT BOARD ASSEMBLY

(75) Inventor: Yoshihiko Shindo, Aichi (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 117 days.

(21) Appl. No.: 13/338,105

(22) Filed: Dec. 27, 2011

(65) Prior Publication Data

US 2012/0164851 A1 Jun. 28, 2012

(30) Foreign Application Priority Data

Dec. 28, 2010 (JP) ..... 2010-293155

(51) Int. Cl.
*H01R 12/00* (2006.01)

(52) U.S. Cl.
USPC ..... 439/79; 439/540.1

(58) Field of Classification Search
USPC ..... 439/55, 78, 79, 108, 607.11, 637–639, 439/660, 540.1
See application file for complete search history.

(56) References Cited

U.S. PATENT DOCUMENTS

| | | | | |
|---|---|---|---|---|
| 5,112,233 | A | 5/1992 | Lybrand | |
| 5,199,886 | A | 4/1993 | Patterson | |
| 5,702,257 | A | 12/1997 | Millhimes | |
| 8,011,966 | B1 * | 9/2011 | Tang et al. | 439/638 |
| 8,083,530 | B2 * | 12/2011 | Kobayashi | 439/79 |
| 8,092,235 | B2 * | 1/2012 | Frantum et al. | 439/79 |
| 2009/0176402 | A1 | 7/2009 | Honda | |

FOREIGN PATENT DOCUMENTS

| | | | |
|---|---|---|---|
| EP | 1107400 | A1 | 6/2001 |
| GB | 2024539 | A | 1/1980 |
| JP | 2005-327589 | A | 11/2005 |
| JP | 2009-163991 | A | 7/2009 |
| JP | 2010-113976 | A | 5/2010 |

OTHER PUBLICATIONS

European Search Report, dated May 24, 2013, 6 pages.

* cited by examiner

*Primary Examiner* — Khiem Nguyen
(74) *Attorney, Agent, or Firm* — Barley Snyder

(57) ABSTRACT

The invention has an object to provide a circuit board assembly for a circuit board, the circuit board assembly having a contact and a housing. The housing includes a contact holding plate having a receiving passageway located in a surface of the contact holding plate disposed perpendicular to a surface of a circuit board, and a contact securing portion. The contact includes a press-fit into and held by the contact securing portion of the receiving passageway, and having a board insertion portion positioned perpendicular to the surface of the circuit board inserted into the receiving passageway from a side of the board insertion portion with respect to the contact holding plate, and a housing insertion section extending in parallel to the surface of the circuit board inserted into the receiving passageway from a side of the board insertion portion with respect to the contact holding plate.

13 Claims, 7 Drawing Sheets

CIRCUIT BOARD ASSEMBLY, BOARD DEVICE, AND METHOD FOR ASSEMBLING CIRCUIT BOARD ASSEMBLY

CROSS-REFERENCE TO RELATED APPLICATIONS

This application claims the benefit of the filing date under 35 U.S.C. §119(a)-(d) of Tyco Electronics Japan G.K. Patent No. 2010-293155, filed on Dec. 28, 2010.

FIELD OF THE INVENTION

The present invention relates to a circuit board assembly and in particular to a circuit board assembly having connector that does not require bending of a contact during assembly.

BACKGROUND

When a wire is connected to a circuit board from the outside, a board side connector is generally provided with the circuit board to mate with a wire side connector generally provided for the wire.

Known board side connectors include a housing, and a plurality of terminals held in the housing. One end of a terminal is inserted into a receiving passageway formed in the circuit board, and the terminal and a conductive pattern provided around the receiving passageway are soldered and electrically connected.

Known board side connectors may include a vertical type connector with which a wire side connector is mated in a direction perpendicular to a surface of a circuit board, or a horizontal type connector with which a wire side connector is mated in a direction parallel to a surface of a circuit board.

As shown in FIG. 7A, in a known wire connector 1 of a horizontal type, a terminal 2 has a substantially L shape so that a board side end 2*a* is perpendicular to a surface 3*a* of a circuit board 3, and a tip 2*b* engaging a female terminal of the wire side connector extends in parallel with the surface 3*a* of the circuit board 3 (for example, see Japanese Patent Laid-Open No. 2010-113976 and Japanese Patent Laid-Open No. 2005-327589).

However, it is difficult to ensure positional accuracy of the board side end 2*a* of the terminal 2 inserted into the receiving passageway formed in the circuit board 3 for the known wire connector 1 using the substantially L-shaped terminal 2.

Specifically, the substantially L-shaped terminal 2 originally has a straight shape, as shown in FIG. 7B. Initially, the terminal 2 is inserted into a receiving passageway 5 formed in a housing 4. At this time, the terminal 2 is inserted from a side of a hood portion 4*a* of the housing 4 which the wire side connector engages. Then, as shown in FIG. 7C, the terminal 2 is press-fit into the receiving passageway 5 in the housing 4. Then, as shown in FIG. 7A, the terminal 2 is bent 90 degrees and deformed into the substantially L shape.

During assembly, when the straight terminal 2 is first inserted into the receiving passageway 5, a slight displacement of an insertion angle from the hood portion 4*a* of the housing 4 causes a large displacement of the board side end 2*a* of the terminal 2 after bending. To prevent the displacement, accuracy in the molding of the housing 4 and the terminal 2, or the like needs to be increased, but increasing accuracy as intended is difficult in view of cost.

The terminal 2 is inserted into the housing 4 and then bent to cause springback, and this causes displacement of the board side end 2*a* of the terminal 2 in a Z direction in FIG. 7A. The terminal 2 is naturally bent in view of an amount of deformation by the springback, but still the position of the board side end 2*a* of the terminal 2 varies in the Z direction.

If the position of the board side end 2*a* of the terminal 2 varies, board side ends 2*a* of all terminals 2 cannot be smoothly inserted into receiving passageways formed in the circuit board 3 in mounting the wire connector 1 on the circuit board 3. Thus, conventionally, a terminal alignment plate 6 having a receiving passageway through which the board side end 2*a* of each terminal 2 is inserted is provided on the housing 4 to correct variations in position of the board side end 2*a* of the terminal 2.

However, if the terminal alignment plate 6 is provided, the number of components of the wire connector 1 is increased, which requires more work during assembly and increases cost.

With the terminal alignment plate 6, when the circuit board 3 and the board side end 2*a* of the terminal 2 are soldered by reflow, the terminal alignment plate 6 blocks hot air for melting solder paste previously applied onto the wiring pattern of the circuit board 3. Then, soldering cannot be reliably performed in some cases, which increases the rate of occurrence of defective products.

Also, with the terminal alignment plate 6, when spray antiseptic is applied after the wire connector 1 is mounted on the circuit board 3, the terminal alignment plate 6 prevents the antiseptic from being applied onto a back side region of the terminal alignment plate 6.

Further, with the terminal alignment plate 6, a footprint of the wire connector 1 on the circuit board 3 is increased by a area of the terminal alignment plate 6, which prevents effective use of space on the circuit board 3.

For such problems, a technique described in Japanese Patent Laid-Open No. 2009-163991 proposes that a terminal is partially held in a housing to increase positional accuracy along a board side end of the terminal.

However, in this technique, a first horizontal portion extending in an inserting direction of the terminal into the housing, and also a first connecting portion extending in a direction perpendicular to the first horizontal portion are held in the housing. Thus, a groove must be formed in the housing to hold the first connecting portion, which complicates a structure of the housing, and requires work in assembling the terminal to the housing.

SUMMARY

An object of the invention is to provide a circuit board assembly, a board device, and a method for assembling the circuit board assembly that can increase efficiency of assembling and further increase positional accuracy of a terminal.

The circuit board assembly includes a contact and a housing. The housing includes a contact holding plate having a receiving passageway located n a surface of the contact holding plate disposed perpendicular to a surface of a circuit board, and a contact securing portion. The contact includes a press-fit into and held by the contact securing portion of the receiving passageway, and having a board insertion portion positioned perpendicular to the surface of the circuit board inserted into the receiving passageway from a side of the board insertion portion with respect to the contact holding plate, and a housing insertion section extending in parallel to the surface of the circuit board inserted into the receiving passageway from a side of the board insertion portion with respect to the contact holding plate.

The invention has another object to reduce the rate of occurrence of defective products, and allow antiseptic to be easily applied.

DETAILED DESCRIPTION OF THE EMBODIMENT(S)

Now, the present invention will be described in detail based on an embodiment shown in the accompanying drawings.

Figure 1A:
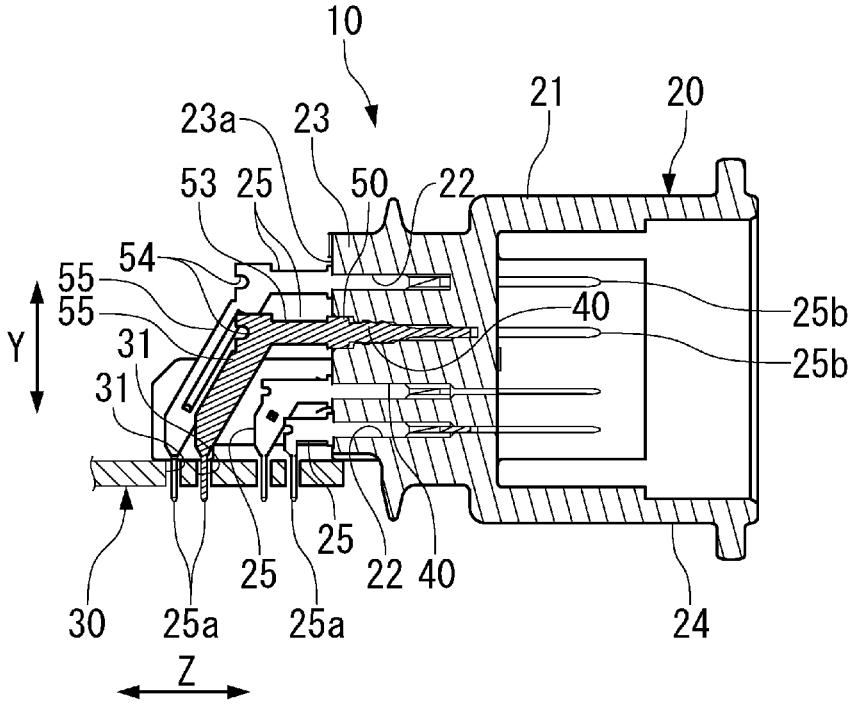
FIG. 1A is a sectional view of an electrical control device having an electrical connector according to the invention.

As shown in FIG. 1A, an electrical control device 10 includes a circuit board assembly including an electrical connector 20 and a circuit board 30.

The circuit board 30 functions as a control circuit on which various electronic components are mounted, and that performs a predetermined operation as an electrical control device.

The electrical connector 20 supplies power from outside to the circuit board 30 or inputs and outputs an electric signal and, specifically, a counterpart connector provided at one end of a wire harness is connected from outside.

Figure 2:
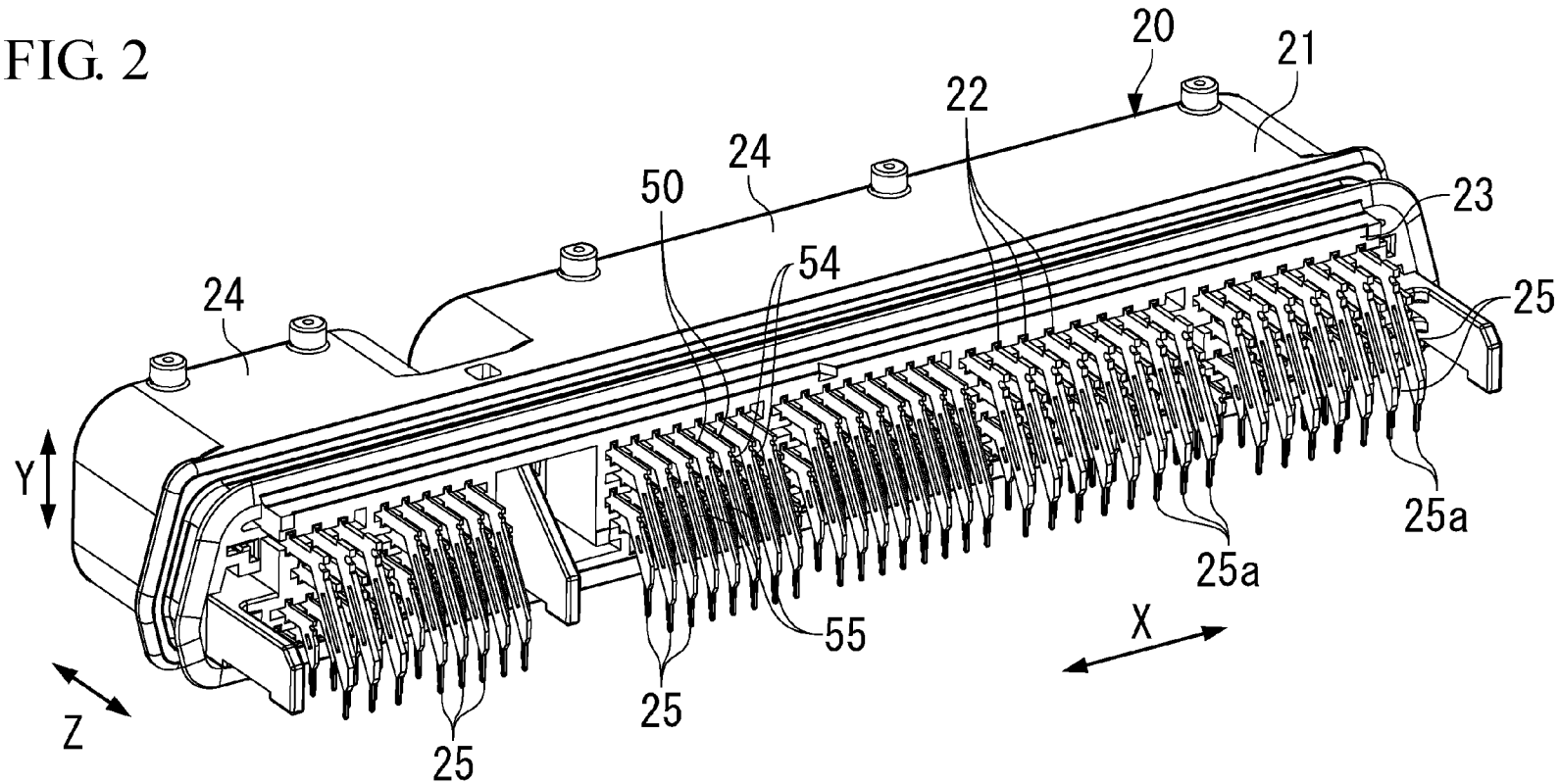
FIG. 2 is a perspective view of the electrical connector according to the invention.

As shown in FIGS. 1A and 2, the electrical connector 20 includes a housing 21 made of resin and a plurality of contacts 25 made of a conductive material.

Figure 3:
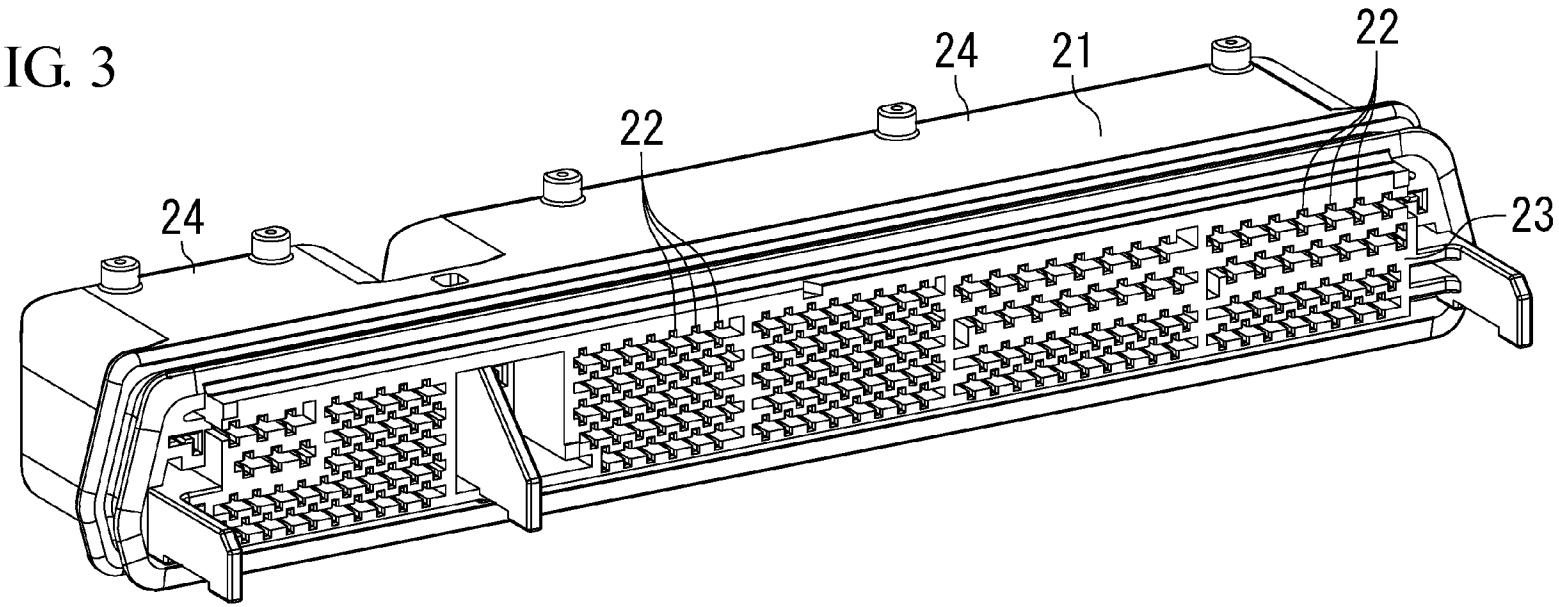
FIG. 3 is a perspective view of the housing of the electrical connector.

As shown in FIG. 3, the housing 21 includes a contact holding plate 23 having receiving passageways 22 that hold the plurality of contacts 25 in a surface perpendicular to a surface of the circuit board 30.

As shown in FIG. 1A, the contact 25 (held in each receiving passageway 22 in the contact holding plate 23) is bent on one side of the contact holding plate 23, and a board insertion portion 25*a* extends in a direction perpendicular to a surface of the circuit board 30 and is inserted into a receiving passageway 31 formed in the circuit board 30. The board insertion portion 25*a* of the contact 25 is electrically connected by soldering to an inner peripheral surface of the receiving passageway 31 and a conductive pattern is formed therearound.

On the other side of the contact holding plate 23, the housing insertion section 25*b* of the contact 25 extends in parallel with the surface of the circuit board 30.

Figure 4:
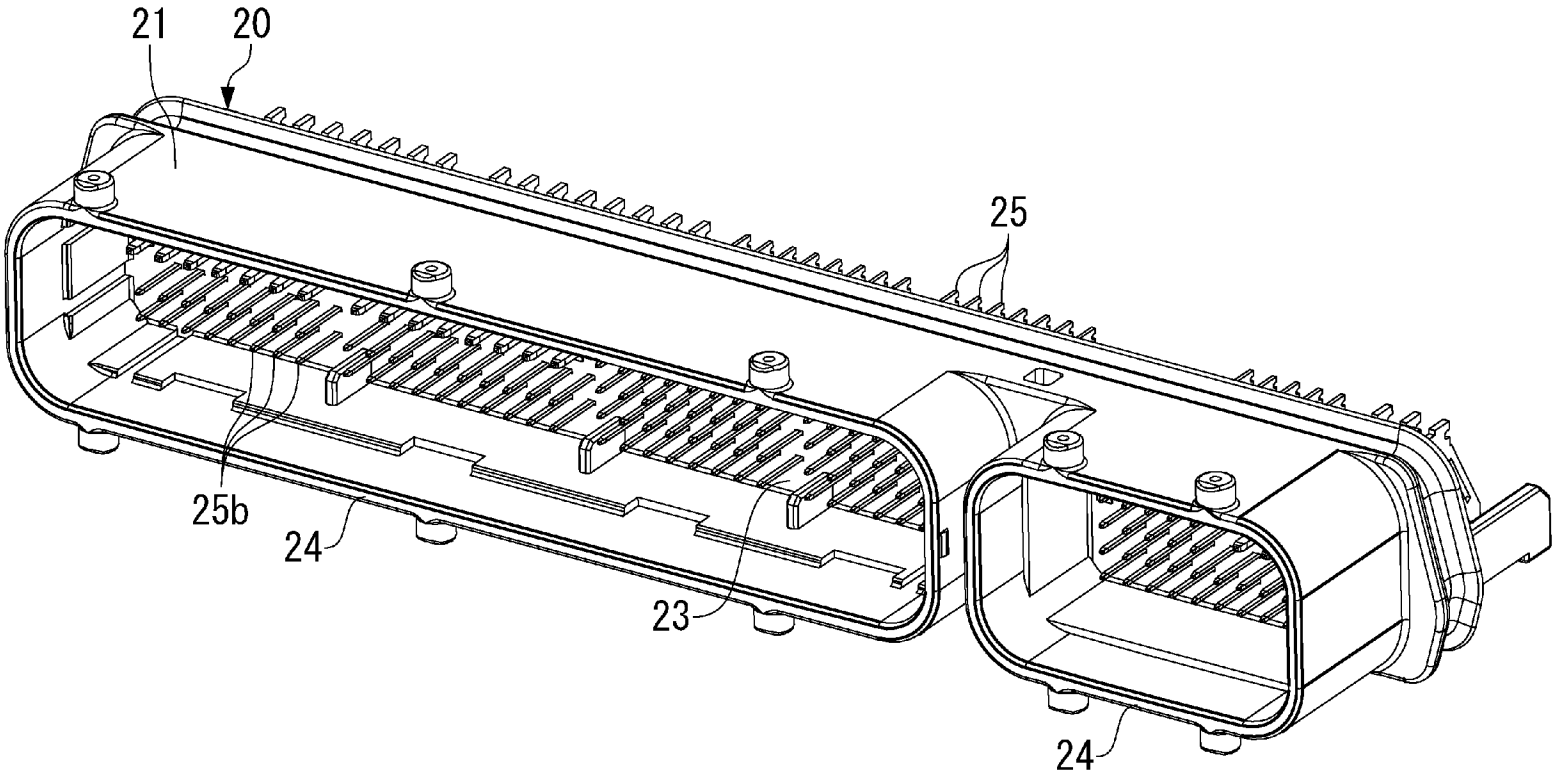
FIG. 4 is a front perspective view of the electrical connector in FIG. 2.

As shown in FIGS. 1A and 4, the housing 21 includes a cylindrical hood portion 24 extending from the contact holding plate 23 to a side of the housing insertion section 25*b* of the contact 25, and the hood portion 24 surrounds the housing insertion sections 25*b* of the plurality of contacts 25. In this embodiment, two hood portions 24 having different sizes are provided.

A mating connector (male connector, not shown) provided at a tip of an unshown wire harness and connected to the electrical control device is inserted into the hood portion 24, and a mating contact (female contact, not shown) held by the mating connector of a wire cord engages the housing insertion section 25*b* of the contact 25 in the hood portion 24 for electrical connection.

Figure 1B:
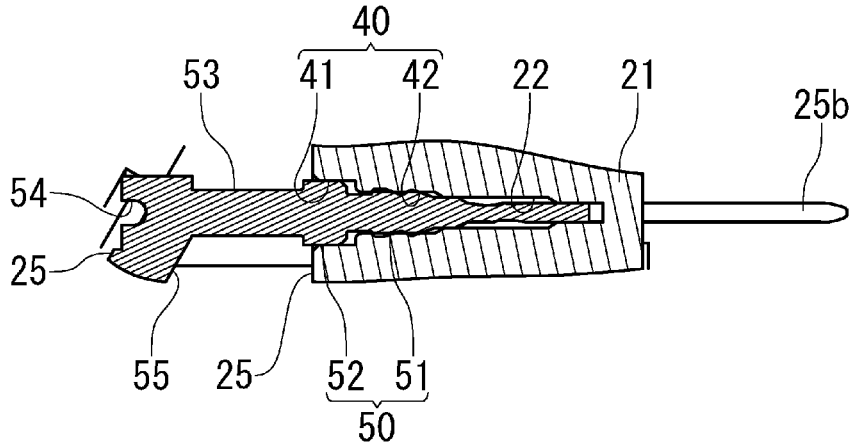
FIG. 1B is an enlarged sectional view of an electrical connector according to the invention showing a press-fitting holding portion of a contact into a housing.

As shown in FIGS. 1A and 1B, the receiving passageway 22 formed in the contact holding plate 23 has a press-fitting holding portion 40 into which the contact 25 is press-fit on a side of the board insertion portion 25*a* of the contact 25 in the contact holding plate 23.

The press-fitting holding portion 40 includes a regulating portion 41 formed to a predetermined depth from a surface 23*a* of the contact holding plate 23 on the side of the board insertion portion 25*a* of the contact 25, and a contact securing portion 42 formed on a back of the regulating portion 41 (side closer to the housing insertion section 25*b* of the contact 25 than the regulating portion 41).

Figure 5A:
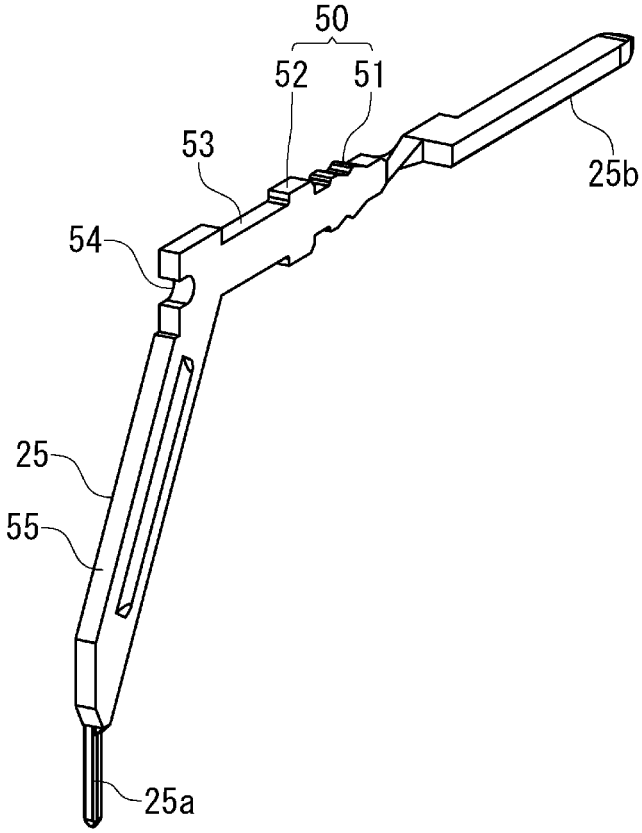
FIG. 5A is a perspective view of the contact of the electrical connector according to the invention.
Figure 5B:
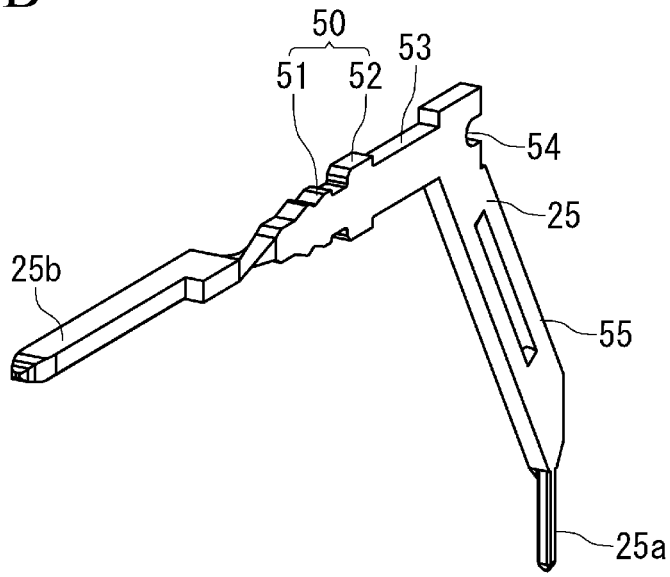
FIG. 5B is another perspective view of the contact of the electrical connector according to the invention.

As shown in FIGS. 5A and 5B, the contact 25 includes a press-fit portion 50 press-fit into the contact securing portion 42 on the side of the housing insertion section 25*b*. The press-fit portion 50 includes an engaging section 51 having, in its surface, irregularities that engage the contact securing portion 42, and a control portion 52 inserted into the regulating portion 41. The control portion 52 has substantially the same height in the direction perpendicular to the surface of the circuit board 30 as the regulating portion 41 (in the Z-direction), and prevents the contact 25 from being displaced in the direction perpendicular to the surface of the circuit board 30 (Y direction).

The regulating portion 41 fits with the control portion 52 of the contact 25 to control an insertion depth of the contact 25 into the receiving passageway 22 in the Z direction (direction perpendicular to the surface 23*a* of the contact holding plate 23, and inserting direction of the contact 25 into the contact holding plate 23).

The contact securing portion 42 secures the contact 25 through friction between the contact securing portion 42 and the engaging section 51 of the contact 25 to prevent the contact 25 from dropping off the receiving passageway 22.

As shown in FIGS. 1A and 1B, the contact 25 has the press-fit portion 50 engage with the contact securing portion 42, and a elongated portion 53 formed continuously with the press-fit portion 50 in a direction perpendicular to the surface 23*a* of the contact holding plate 23 on the side of the board insertion portion 25*a* of the contact 25.

At an end of the elongated portion 53, an engaging recess 54 having a recessed shape toward the housing insertion section 25*b* is formed in the embodiment shown.

Between the elongated portion 53 and the board insertion portion 25*a* of the contact 25, an oblique bar 55 is provided obliquely so as to be gradually closer to the contact holding plate 23 from the side of board insertion portion 25*a* with distance from the surface of the circuit board 30.

With reference back to the housing 21, the receiving passageways 22 are formed in multiple columns having different distances (heights) from the surface of the circuit board 30. The contacts 25 are held in the receiving passageways 22 in each column. Positions of board insertion portions 25*a* in the direction perpendicular to the surface of the circuit board 30 are aligned so that the board insertion portions 25*a* are inserted into the receiving passageways 31 in the circuit board 30.

In the embodiment shown, the receiving passageways 22 in the multiple columns are also provided in multiple rows in a direction parallel to the surface of the circuit board 30.

The contact 25 is formed by punching a metal plate. A thickness of the metal plate is a matter of design choice, and can be appropriately set. Thus, in the electrical connector 20, the thickness of the contact 25 in an arranging direction of the plurality of contacts 25 (direction along the surface of the circuit board 30 and perpendicular to an extending direction of the receiving passageway 22: X direction) is the same as the thickness of the metal plate. Too thick of a metal plate prevents clearance between adjacent contacts 25 in the X direction, and thus the thickness needs to be precisely set.

The contact 25 is bent 90° on the side of the housing insertion section 25*b* from the contact securing portion 42 in the receiving passageway 22. Thus, the housing insertion section 25*b* of the contact 25 mates with a mating contact at an original metal surface rather than a cut surface.

To assemble the electrical connector 20 as described above, a contact press-fitting device (not shown) is used to mechanically press-fit the contact 25 into each receiving passageway 22 in the housing 21.

Figure 6:
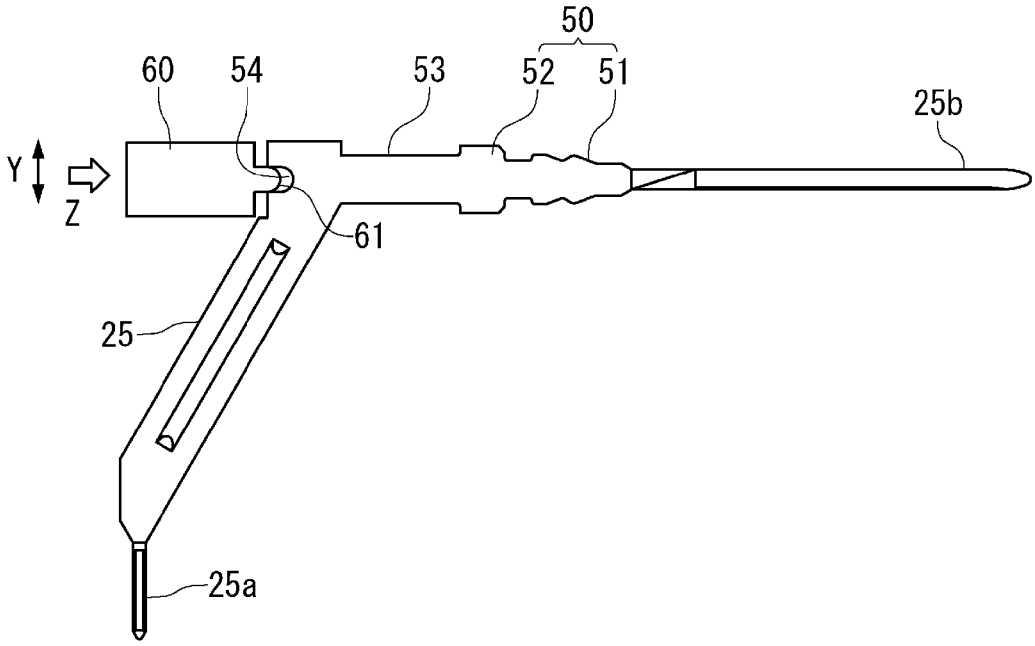
FIG. 6 is a side view of the contact and a press-fitting tool according to the invention for insertion of the contact into the housing.
Figure 7A:
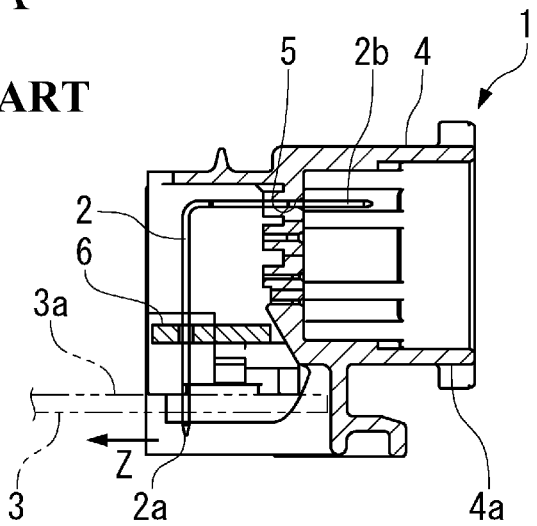
FIG. 7A PRIOR ART
FIG. 7A is a sectional view of a known electrical connector.
Figure 7B:
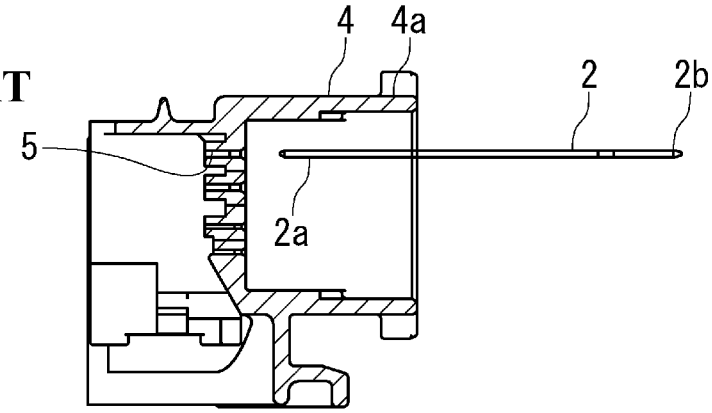
FIG. 7B PRIOR ART
FIG. 7B is another sectional view of the known electrical connector before insertion of a straight contact into a housing.
Figure 7C:
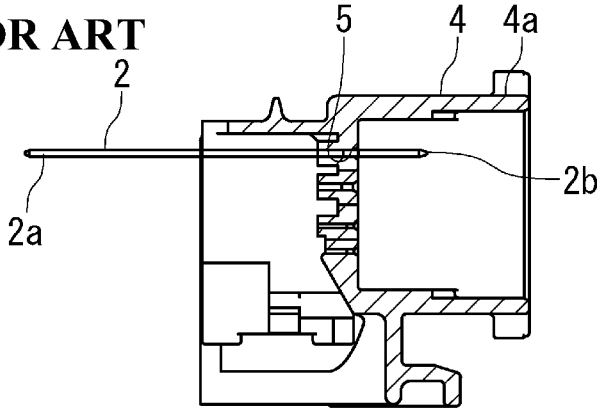
FIG. 7C PRIOR ART
FIG. 7C is another sectional view of the known electrical connector showing the contact being inserted into the housing.

At this time, the contact 25 is press-fit into the receiving passageway 22 from the side of the surface 23*a* of the contact holding plate 23. Further, as shown in FIG. 6, the contact 25 may be press-fit into the receiving passageway 22 by a contact press-fitting device using a jig 60 having a protrusion 61 that engages an engaging recess 54 formed at an end of the elongated portion 53. The contact press-fitting device automatically controls an insertion stroke of the contact 25 into the receiving passageway 22, and this ensures press-fitting positional accuracy of the contacts 25 in the Z direction of the extending contact 25. Further, the protrusion 61 of the jig 60 engages the engaging recess 54 to ensure a position and a press-fitting angle of an end of the elongated portion 53 of the contact 25 in the Y direction perpendicular to the surface of the circuit board 30.

As such, accuracy is ensured of the press-fitting position and the angle of the contact 25 by the contact press-fitting device in press-fitting of the contact 25 into the receiving passageway 22.

The contact 25 press-fit into the receiving passageway 22 is held by the press-fitting holding portion 40 formed in the receiving passageway 22. Friction between the contact securing portion 42 in the press-fitting holding portion 40 and the press-fit portion 50 of the contact 25 secures the contact 25 to the contact securing portion 42, prevents the contact 25 from dropping off the receiving passageway 22, and prevents displacement of the press-fit contact 25 in the extending direction of the receiving passageway 22 (Z direction) and the direction perpendicular to the receiving passageway 22 (Y direction and X direction).

This ensures accuracy and precision of the position and the angle of the press-fit contact 25.

As described above, the position and the angle of the contact 25 with respect to the housing 21 can be ensured with high accuracy.

Further, the contact 25 is press-fit into the receiving passageway 22 from the side of the surface 23*a* of the contact holding plate 23 where the board insertion portion 25*a* to be inserted into the receiving passageway 31 in the circuit board 30 is located. Thus, as compared to the case of press-fitting from the opposite side, a pressing position (end of the elongated portion 53, engaging recess 54) of the contact 25 by the jig 60 is close to the board insertion portion 25*a* of the contact 25. This can reduce errors in the press-fitting position and the angle of the contact 25 by the contact press-fitting device using the jig 60 at the board insertion portion 25*a* of the contact 25.

The contact 25 is formed by punching the metal plate, and there is no need to bend the contact 25 after being press-fit into the receiving passageway 22 as is conventional, thereby allowing the contact 25 itself to be formed with high accuracy.

Further, since there is no need to bend the contact 25, the metal plate that forms the contact 25 may have a larger thickness than a conventional contact that requires bending. This can increase strength of the contact 25 in the X direction, which also ensures positional accuracy of the board insertion portion 25*a* of the contact 25.

As such, positional accuracy of the board insertion portion 25*a* of the contact 25 with the contact 25 being assembled to the housing 21 can be significantly increased. This eliminates the need to provide a terminal alignment plate in the housing 21. This can reduce the number of components that constitute the electrical connector 20, allow efficient assembling, and reduce cost. Since the terminal alignment plate is not provided, a footprint of the electrical connector 20 on the circuit board 30 can be reduced to allow effective use of space on the circuit board 30.

Further, when the board insertion portion 25*a* of the contact 25 and the circuit board 30 are soldered by reflow, hot air for melting solder paste previously applied onto the wiring pattern of the circuit board 30 is not blocked, thereby ensuring soldering and reducing the rate of occurrence of defective products. Also, because the terminal alignment plate is not provided, when spray antiseptic is applied after the electrical connector 20 is mounted on the circuit board 30, the antiseptic can be evenly applied all over.

The contact 25 is held by the press-fitting holding portion 40 formed in the receiving passageway 22, thereby ensuring the position of the board insertion portion 25*a* only by press-fitting into the receiving passageway 22 with high accuracy. This also allows efficient assembling.

Further, the contact 25 includes the oblique bar 55. Thus, when a soldered portion is tested after the electrical connector 20 is mounted on the circuit board 30, the contact 25 does not interfere with a camera photographing the electrical connector 20 from obliquely upward, thereby allowing the soldered portion to be reliably photographed for test.

The configurations of components of the electrical connector 20 have been described, but the configurations described in the embodiment may be chosen or changed to other configurations without departing from the spirit of the present invention.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A circuit board assembly for a circuit board, the circuit board assembly comprising:

a housing including a contact holding plate having a receiving passageway:

(a) in a surface of the contact holding plate disposed perpendicular to a surface of a circuit board, and (b) a contact securing portion; and a contact:

(a) press-fit into and held by the contact securing portion of the receiving passageway, and (b) having:

(1) a board insertion portion positioned perpendicular to the surface of the circuit board inserted into the receiving passageway from a side of the board insertion portion with respect to the contact holding plate, and (2) a housing insertion section extending in parallel to the surface of the circuit board inserted into the receiving passageway from a side of the board insertion portion with respect to the contact holding plate.

2. The circuit board assembly according to claim 1, wherein the contact further includes an oblique bar section positioned between the board insertion portion and the housing insertion section.

3. The circuit board assembly according to claim 2, wherein the oblique bar section obliquely extends from a side of the board insertion portion toward a side of the housing insertion section.

4. The circuit board assembly according to claim 3, wherein the housing insertion section has an press-fitting holding portion at an end on a side of the board insertion portion.

5. The circuit board assembly according to claim 4, wherein the press-fitting holding portion engages a press-fit portion of the contact to press and insert the contact into the receiving passageway in the housing while positioning the housing insertion section in a direction perpendicular to the surface of the circuit board.

6. The circuit board assembly according to claim 5, wherein the press-fitting holding portion includes a regulating portion formed to a predetermined depth from a surface of the contact holding plate on the side of the board insertion portion of the contact.

7. The circuit board assembly according to claim 6, wherein the contact securing portion formed on a back of the regulating portion.

8. The circuit board assembly according to claim 7, wherein the press-fit portion is press-fit into the contact securing portion on the side of the housing insertion section.

9. The circuit board assembly according to claim 7, wherein the press-fit portion includes an engaging section having irregularities along a surface there of to engage the contact securing portion.

10. The circuit board assembly according to claim 9, wherein the press-fit portion further includes a control portion inserted into the regulating portion and having substantially the same height in a direction perpendicular to the surface of the circuit board as the regulating portion.

11. The circuit board assembly according to claim 10, wherein the regulating portion snug fits with the control portion of the contact to control an insertion depth of the contact into the receiving passageway.

12. The circuit board assembly according to claim 1, wherein the positioning portion arranges the contact in an inserting direction of the contact into the receiving passageway.

13. The circuit board assembly according to claim 12, wherein the contact is formed by punching a metal plate.

* * * * *